US005856657A

United States Patent [19]

Hoh

[11] Patent Number: 5,856,657

[45] Date of Patent: Jan. 5, 1999

[54] AUTOMATIC POWER SUPPLY CUT-OFF APPARATUS FOR A MICROWAVE OVEN

[75] Inventor: Jung-Eui Hoh, Suwon, Rep. of Korea

[73] Assignee: Samsung Electronics Co., Ltd., Suwon, Rep. of Korea

[21] Appl. No.: 886,246

[22] Filed: Jul. 1, 1997

[30] Foreign Application Priority Data

Jan. 7, 1996 [KR] Rep. of Korea ..... 9-6-19543 [U]

[51] Int. Cl.[6] ..... H05B 6/68

[52] U.S. Cl. ..... 219/723; 219/702; 219/715; 219/756

[58] Field of Search ..... 219/723, 722, 219/724, 756, 702, 715; 200/50.02, 50.14, 50.08, 50.1, 61.62, 61.76, 61.81

[56] References Cited

U.S. PATENT DOCUMENTS

| | | | |
|---|---|---|---|
| 3,691,329 | 9/1972 | Ball | 219/722 |
| 4,277,659 | 7/1981 | DeRemer | 200/61.62 |
| 4,321,445 | 3/1982 | Kristof et al. | 219/722 |
| 5,235,150 | 8/1993 | Buske et al. | 219/722 |

FOREIGN PATENT DOCUMENTS

| | | | |
|---|---|---|---|
| 52-37241 | 3/1977 | Japan | 219/723 |
| 55-56534 | 4/1980 | Japan | 219/722 |

*Primary Examiner*—Philip H. Leung
*Attorney, Agent, or Firm*—Burns, Doane, Swecker & Mathis, L.L.P.

[57] ABSTRACT

A microwave oven includes a power cut-off safety switch which automatically cuts-off the supply of electric power to the oven if a housing panel is removed while the electric power supply cord is still plugged in. The switch is engaged by an extension of the housing panel which extends through a guide hole formed by another housing panel. The guide hole can have a non-planar shape to resist efforts to insert objects through the guide hole.

8 Claims, 3 Drawing Sheets

AUTOMATIC POWER SUPPLY CUT-OFF APPARATUS FOR A MICROWAVE OVEN

BACKGROUND OF THE INVENTION

1. Field of the Invention

The present invention relates to a microwave oven and, in particular, to increasing the safety of workers performing repairs or maintenance thereon.

2. Description of the Prior Art

A conventional microwave oven, as illustrated in FIGS. 1 and 2, includes a cooking chamber 60 formed by a housing. The housing comprises various panels, including a front panel 20, a back panel 30, a base panel 40 and a removable outer panel 50. A turntable 70 is disposed on a floor of the cooking chamber 60. A door 80 is provided for opening and closing the cooking chamber 60, and a control unit 90 is provided for establishing cooking function modes or for operating a magnetron (not shown), or the like.

In order to drive the microwave oven thus constructed, when a door open button at the control unit 90 is pressed while an electric cord 100 is still plugged in an electrical outlet, the door 80 is opened to light a lamp in the cooking chamber 60.

At this time, food is placed on the turntable 70, the door 80 is closed, a desired cooking time and cooking menu and the like are input by way of the control unit 90, and a start button is pressed. Then the turntable 70 is rotated in one direction as a high frequency of 2,450 MHZ is generated according to an oscillating operation of a magnetron (not shown) to thereafter be dispersed in the cooking chamber 60.

The high frequency dispersed in the cooking chamber 60 is reflected from metal walls therein and is radiated to the food on the turntable 70 to thereby heat the food.

However, there is a problem in the conventional microwave oven thus constructed in that an electric shock to a worker can happen when the outer panel 50 is separated while the electric cord 100 is still plugged in the outlet during repair or maintenance of the product.

SUMMARY OF THE INVENTION

Accordingly, the present invention is provided to solve the aforementioned problem and it is an object of the present Invention to provide a power supply cut-off apparatus of a microwave oven by which an input power supply is automatically cut off, to thereby prevent an electric shock, when an outer panel is separated while the electric cord is still plugged in an electric outlet.

The present invention involves a microwave oven comprising a housing formed by interconnected housing portions, a cooking chamber disposed in the housing, a door for opening and closing the cooking chamber, a control unit for establishing a cooking operation, an electrical cord for supplying electrical power to the oven, and a power supply cut off means mounted in the oven for automatically cutting off the supply of electric power in response to an opening up of a portion of the housing.

The cut off means preferably comprises a switch which is arranged to be contacted by one of the housing portions.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF PREFERRED

Embodiments of the Invention

Figure 1:
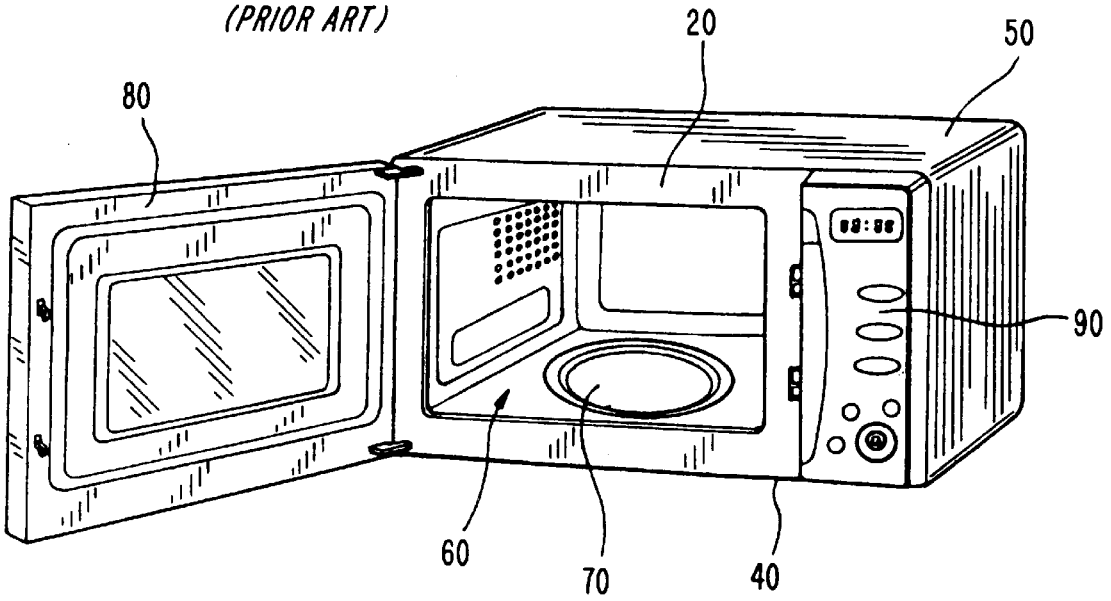
FIG. 1 (PRIOR ART)
FIG. 1 is a perspective view for illustrating a front surface of a microwave oven according to the prior art.
Figure 2:
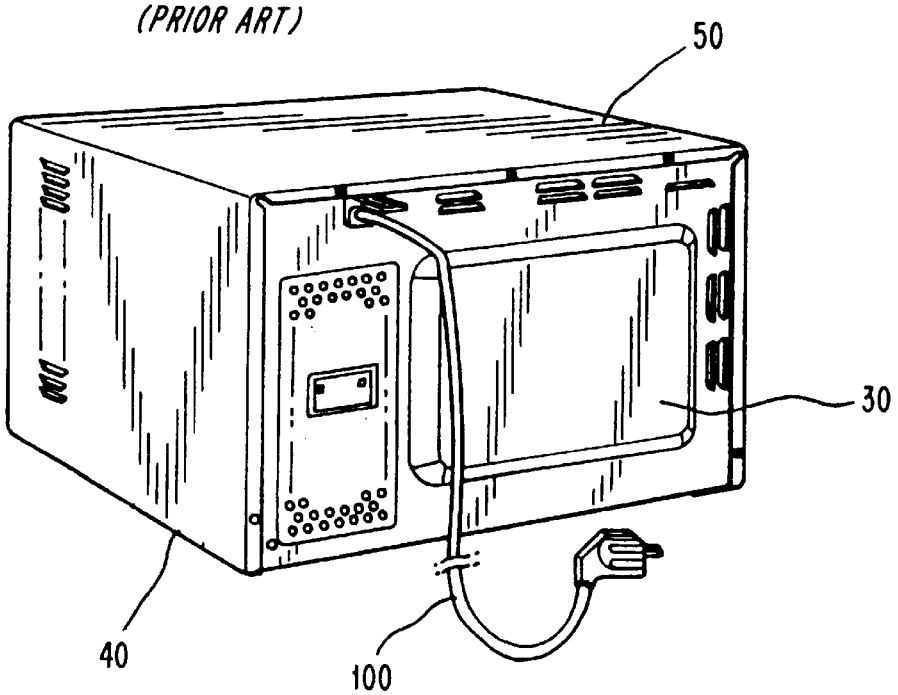
FIG. 2 (PRIOR ART)
FIG. 2 is a perspective view for illustrating a rear surface of a microwave oven according to the prior art.

Embodiments of the present invention will now be described in detail with reference to the accompanying drawings. Throughout the drawings, like reference numerals and symbols are used for the designation of like or equivalent parts or portions for simplicity of illustration and explanation, and redundant reference will be omitted.

Figure 3:
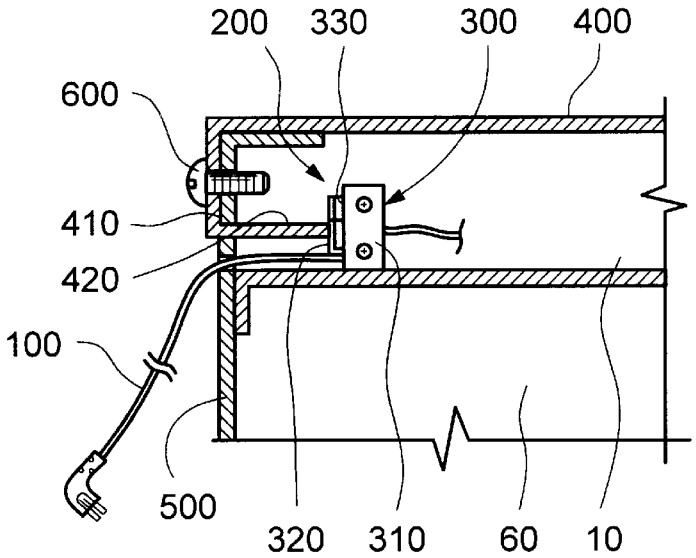
FIG. 3 is a side sectional view of a portion of a microwave oven in an assembled state according to the present invention.
Figure 4A:
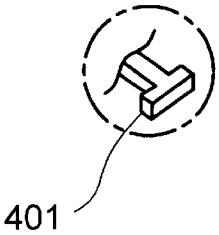
FIG. 4A is a perspective view of a circled portion of FIG. 4.
Figure 4:
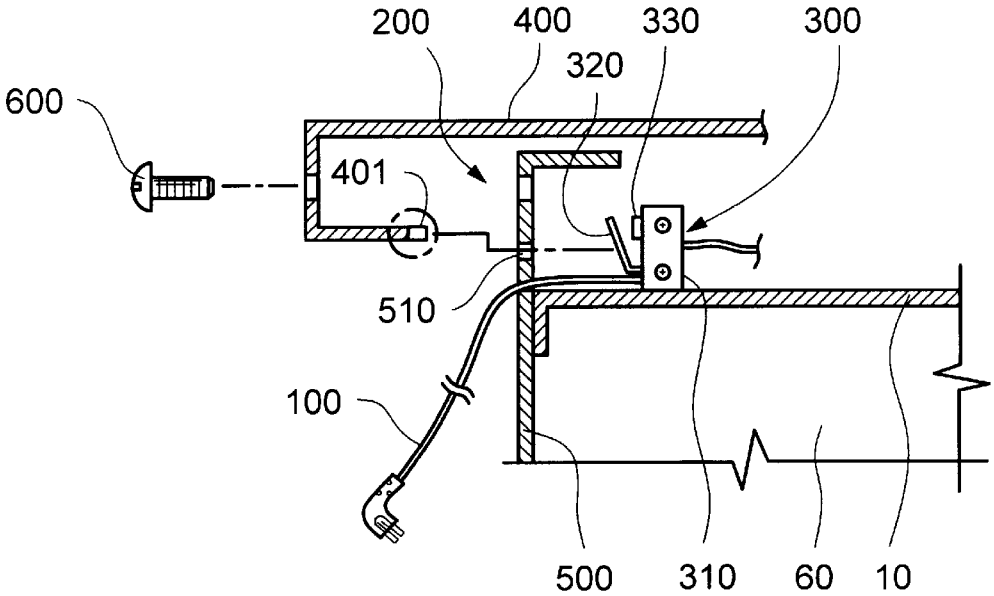
FIG. 4 is a view similar to FIG. 3 with parts of the oven disassembled to cut-off a main power supply.

In FIGS. 3 and 4, reference numeral 200 designates a power supply cut-off means by which an electrical connection is automatically disconnected when the microwave oven is disassembled during repair or maintenance of the microwave oven. Thus, a main power supply applied to the microwave oven is automatically cut off, even if the electric cord is still plugged into an electric socket.

The power supply cut-off means includes a safety switch 300 disposed in a cavity formed between a top wall 10 of the cooking chamber and a removable outer panel 400. As will be explained, the outer panel 400 causes the switch 300 to be turned on when in an assembled state and turns off the switch 300 when in a disassembled state. A back panel 500 is coupled to the wall 10 to guide a part of the outer panel 400 for movement toward the switch 300.

The switch 300, as illustrated in FIGS. 3 and 4 includes a body 310 having fixed and movable contacts (not shown) disposed therein, a button 330 connected to the movable contact, and a rotatable lever 320 releasably engageable with the button 330. The button 330 and lever 320 are spring biased to respective positions shown in FIG. 4 wherein the lever is disengaged from the button, and the movable contact is disengaged from the fixed contact. The lever 320 is rotated according to a removal or installation of the outer panel 400, causing the movable contact to be displaced toward or away from the fixed contact.

The outer panel is formed at a rear side thereof with an L-shaped structure defined by a vertical flange 410 and a horizontal flange or extension 420, the latter able to contact the switch 300 by projecting through an elongated hole formed in the back panel 500. A free end of the horizontal flange 420 is formed with a T-shaped finger 401 which presents a relatively wide surface area able to contact the lever 320. Accordingly, the likelihood of the lever accidentally slipping off the flange 420 is minimized.

The vertical flange 410 is secured to the back panel 500 by a fastening bolt 600.

Figure 5:
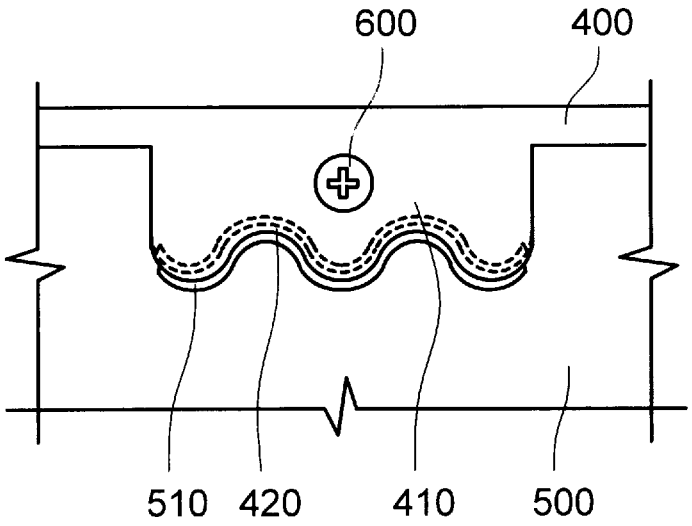
FIG. 5 is a rear view of FIG. 3 depicting one embodiment of the present invention.

As shown in FIG. 5 the horizontal unit 420 and the hole 510 may have a wavy shape in order to resist an attempt to defeat the safety feature, e.g., by the insertion of an object, such as a flat plate member, through a gap formed between the flange 420 and the hole 510.

Next, the operation of the power supply cut-off apparatus of a microwave oven according to one embodiment of the present invention thus constructed will be described.

When the housing of the oven is to be opened-up for repair or maintenance, e.g., when the outer panel 400 End the back panel 500 are disconnected from one another and the outer panel 400 is pulled backward as illustrated in FIG. 4, the horizontal flange 420 is separated from the hole 510 to thereby separate the outer panel 400 from the back panel 500.

Furthermore, the lever 320 of the switch 300 which had been depressed by the horizontal flange 420 is separated from the button 330, whereupon the button is moved to the left by a spring bias.

At this time, the button 330 separates the movable contact from the fixed contact to automatically cut off the power supply applied to the microwave oven if the electric cord 100 is still plugged into an outlet (not shown), thereby preventing the worker from receiving an electrical shock.

Meanwhile, when the repair is finished, and the horizontal flange 420 of the outer panel 400 is inserted into the hole 510 of the back panel 500 in order to reassemble the outer panel 400 to the back panel 500, the horizontal flange 420 presses the lever 320 of the switch 300, as illustrated in FIG. 3, and the lever 320 in turn presses the button 330 to thereby engage the movable contact with the fixed contact thereby re-establishing the supply of power to the microwave oven.

Although the flange 420 and hole 510 have been described as having a wavy shape to prevent flat objects from entering a gap therebetween, the present invention is not limited thereto.

Figure 6:
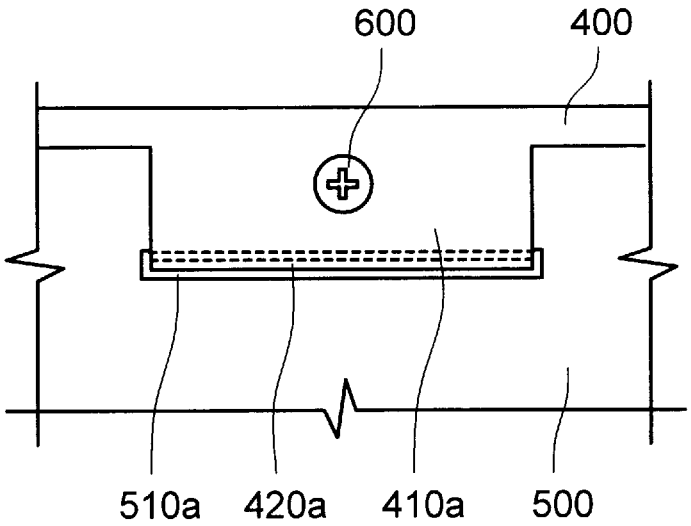
FIG. 6 is a rear view of FIG. 3 for illustrating another embodiment of the present invention.

In other words, as illustrated in FIG. 6, another embodiment of the present invention can be constructed such that an elongated hole 510*a* of the back panel 500 and a horizontal flange 420*a* have a straight or flat shape. Note that the vertical flange blocks an upper portion of the hole 510*a* when the panels 400, 500 are assembled together.

The operation of the flange 420*a* and the button 300 is the same as that of the afore-mentioned embodiment of the present invention.

As is apparent from the foregoing, there results an advantage from the power supply cut-off apparatus in that an electrical connection of a switch is automatically turned off when the outer panel is dismounted while an electric cord is still plugged into an outlet, to thereby cut off a main power supply applied to the microwave oven and prevent an electric shock possibly caused in the course of a repair work of the microwave oven.

What is claimed is:

1. A microwave oven comprising a housing formed by interconnected housing portions, a cooking chamber disposed in the housing, a door for opening and closing the cooking chamber, a control unit for establishing a cooking operation, an electrical cord for supplying electrical power to the oven, and a power supply cut-off means mounted on the microwave oven for automatically cutting off the supply of electric power in response to an opening up of a portion of the housing; the power supply cut-off means including a switch mounted on a first of the housing portions, the switch including a displaceable button movable between a power cut-off position and an energizing position, the button being biased to a power cut-off position, the first housing portion including a hole; the switch further including a lever mounted at one end and facing the hole, the lever including a free end movable toward and away from the button and inherently biased so that the free end thereof is out of context with the button; a second of the housing portions being bent to form an integral finger of one piece therewith, the finger arranged to be passed through the hole and into direct contact with the lever in response to the first and second housing portions being interconnected, for pushing the free end into pushing relationship with the button to move the button into its energizing position.

2. The microwave oven according to claim 1 wherein the first housing portion comprises an upper panel extending above the cooking chamber, and the second housing portion comprising a rear vertical wall of the cooking chamber.

3. The microwave oven according to claim 2 wherein the upper panel forms a cavity together with a top horizontal wall of the cooking chamber; the button and finger mounted in the cavity.

4. The microwave oven according to claim 1 wherein the finger a T-shaped.

5. The microwave oven according to claim 1 wherein the finger and hole are of corresponding non-planar shape as viewed in a direction of travel of the finger within the hole.

6. The microwave oven according to claim 5 wherein the non-planar shape comprises a wavy shape.

7. The microwave oven according to claim 1 wherein the first housing portion includes a vertical section disposed at a rear of the oven, with the finger extending horizontally forwardly from the vertical section.

8. The microwave oven according to claim 7 wherein the vertical section covers an upper portion of the hole.

* * * * *